United States Patent [19]

Rigamonti

[11] 4,159,804

[45] Jul. 3, 1979

[54] MEANS FOR ATOMIZING COSMETIC PRODUCTS

[76] Inventor: Oscar Rigamonti, Via P. Toselli 21, Milan, Italy

[21] Appl. No.: 814,447

[22] Filed: Jul. 11, 1977

[30] Foreign Application Priority Data

Feb. 25, 1977 [IT] Italy ..... 20748/77[U]

[51] Int. Cl.[2] ..... B05B 7/24

[52] U.S. Cl. ..... 239/346

[58] Field of Search ..... 239/340, 341, 346

[56] References Cited

U.S. PATENT DOCUMENTS

| | | | |
|---|---|---|---|
| 1,632,515 | 6/1927 | Smith | 239/346 |
| 2,815,984 | 12/1957 | Llopis | 239/346 X |
| 3,136,486 | 6/1964 | Docken | 239/346 |

FOREIGN PATENT DOCUMENTS

| | | | |
|---|---|---|---|
| 813630 | 6/1937 | France | 239/346 |
| 21692 of | 1912 | United Kingdom | 239/341 |
| 304495 | 1/1929 | United Kingdom | 239/346 |

*Primary Examiner*—Robert W. Saifer

*Attorney, Agent, or Firm*—Kirschstein, Kirschstein, Ottinger & Cobrin

[57] ABSTRACT

Means for atomizing cosmetic products, in particular hair lacquers, in which each bomb to be filled with hair lacquer to be atomized is provided with a controllable valve as well as with an atomizing nozzle unit and in which the said valve and the said nozzle are connected by means of a suitable hose containing means for the generation of compressed air.

4 Claims, 5 Drawing Figures

MEANS FOR ATOMIZING COSMETIC PRODUCTS

BACKGROUND OF THE INVENTION

This invention relates to means for the atomizing of cosmetic products, in particular hair lacquer.

The use of so-called spray bombs for the application of hair lacquers is well known, with the lacquer being expelled in atomized form by means of a halofluorocarbon propellant gas contained within the bomb.

It has now been ascertained that the use of such propellant gases may be harmful to the health and that it would be advisable to abandon the atomizing of hair lacquers and similar cosmetic products by means of propellant gases, for example, chlorofluorocarbide, chlorodifluoromethane and mixtures of chlorodifluoromethane and tetrafluorodifluoroethane.

A further drawback of the said spray bombs consists in their rather high cost of manufacture.

SUMMARY OF THE INVENTION

It is the object of this invention to remove the abovementioned drawbacks by allowing the atomizing of hair lacquers without the use of halofluorocarbon propellant gases and appurtenant spray bombs.

This object is attained according to this invention by using at least one bomb, to be filled with the lacquer to be atomized and provided in a head part with a controllable valve and an atomizing nozzle unit, said container being connected by a suitable hose to means for generating compressed air.

In a preferred advantageous embodiment, more than one bomb can be removably arranged in seats provided in a housing body, with the compressed-air generating means, for example a small piston compressor, seated in the rear part of the said housing body.

The arrangement according to this invention will now be described more in detail with respect to a preferred embodiment thereof given by way of example without being limited thereto and is shown in the accompanying drawings.

DESCRIPTION OF THE PREFERRED EMBODIMENTS

Figure 1:
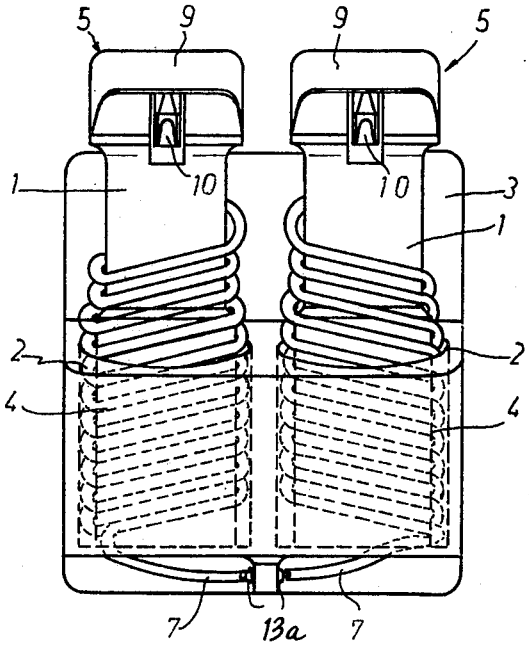
FIG. 1 is a front view of a housing body having two bombs.

As shown in FIG. 1, one or more bombs 1 are arranged with their lower part 4 inserted into a suitable seat 2 of a housing body 3. Each lower part 4 of the relative bomb 1 is designed to receive the lacquer to be atomized. For example, part 4 may be screwed to a head part 5 containing the atomizing mechanism to be described hereinafter.

Figure 2:
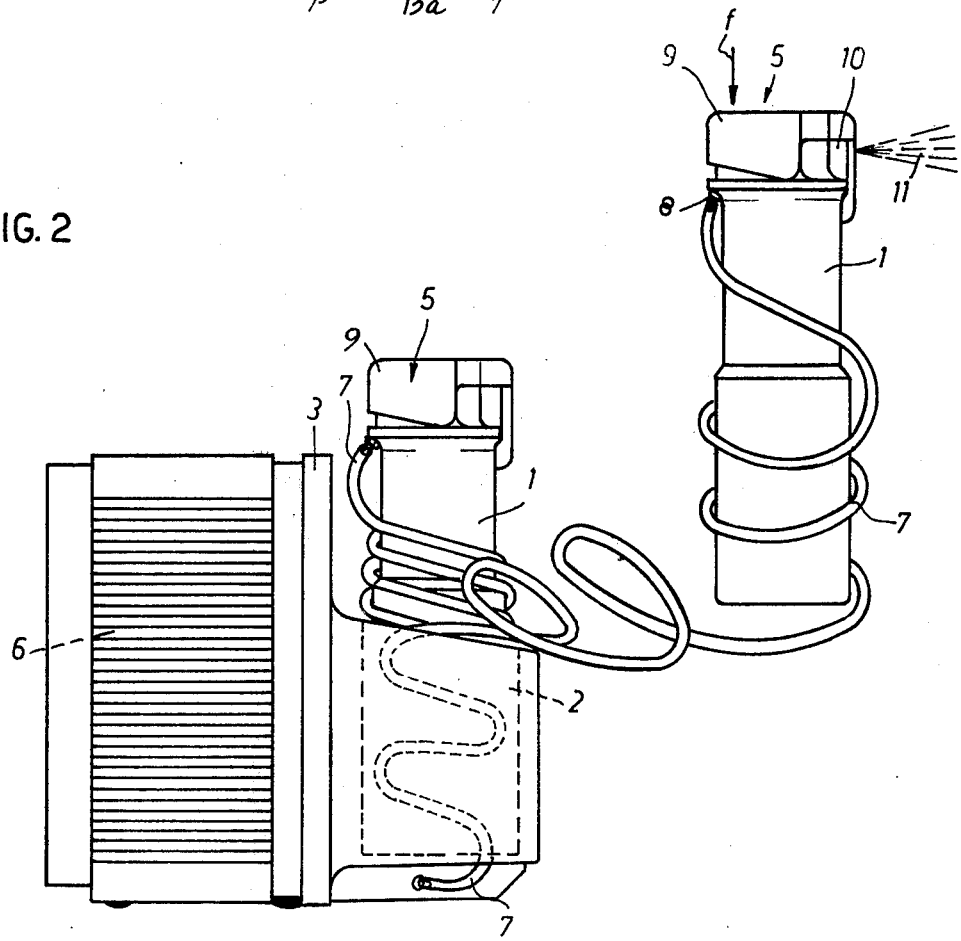
FIG. 2 is a side view of the housing body according to FIG. 1, with one bomb lifted out, along with its compressed-air supply hose.
Figure 4:
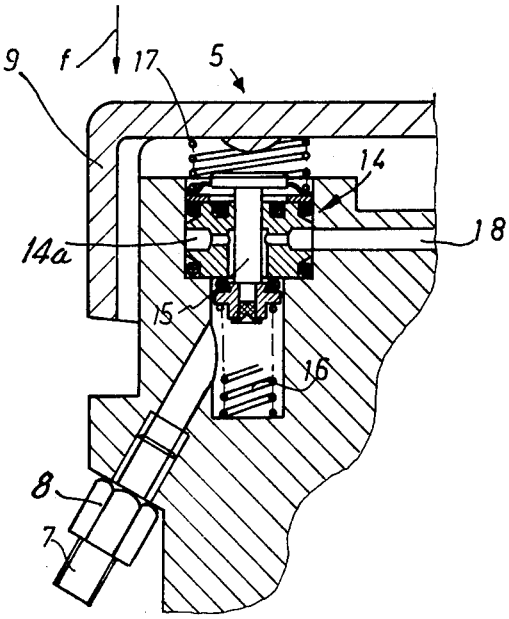
FIG. 4 is a cross-section of a detail showing the compressed-air check valve.

FIG. 2 shows the bombs 1 seated in the seats 2 provided in the front part of the housing body 3. The said housing body 3 has in its rear part a bay 6 suitably designed for receiving a means for the generation of a compressed-air flow, for example a piston compressor (not shown). The outflow side of the compressor is connected by means of a suitable hose 7 to the atomizing head 5 (FIG. 4). The atomizing head 5 comprises a union 8 for connecting the corresponding hose 7. Same union leads to a valve 14 which is controlled by a flat movable cover 9 part of the atomizing head 5. When exerting a pressure on the cover 9 in direction of the arrow f (FIG. 2), the valve 14 will be opened allowing the compressed air to flow from the hose 7 toward the removable spraying nozzle unit 10 and allowing at the same time the lacquer to be expelled in the form of an atomized veil 11. For the purpose, the valve body is provided with a peripheral groove **14*a*** open on the outside.

Advantageously, the hoses 7 surround the corresponding bomb 1 in form of a spiral, allowing the easy extraction of the bomb 1 from its corresponding seat 2 or vice versa, the reseating of the bomb 1 together with its hose 7 into the seat 2.

Figure 3:
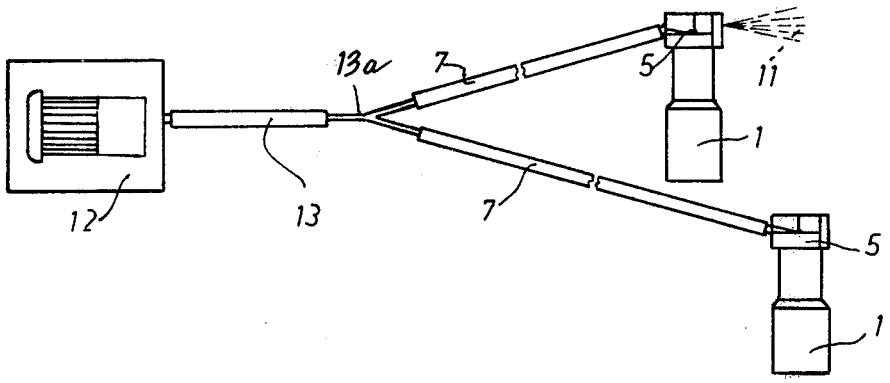
FIG. 3 shows the connection between the compressor and the two bombs for the atomizing of hair lacquer.

FIG. 3 schematically illustrates the compressed-air supply circuit leading to the atomising head 5 of the two bombs 1. From a source of compressed air, for example a compressor 12, a supply hose 13 leads to a 'Y'-ramification **13*a*, whose ramification branches are connected to the flexible hoses 7 leading toward the corresponding atomizing heads 5. Advantageously, the ramification 13*a* is incorporated within the housing body 3, with only the unions for the connection of the hoses 7** being left free (FIG. 4).

FIG. 4 shows a cross-sectional detail of the atomizing head 5, in particular the compressed-air flow check valve. The movable cover 9 of the head 5 allows to operate a spindle valve indicated by 14. The shaft 15 of the said valve, is biased to closed position by a spring 16 in. When pressing the cover 9 in the direction of the arrow f, against the thrust of a spring means 17, the shaft 15 is pushed down allowing the flow of compressed air from the hose 7, through the valve 15, to a channel 18 in the head leading to the atomizing nozzle unit 10.

Figure 5:
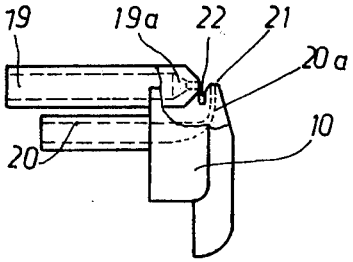
FIG. 5 shows a side view of a removable atomizing nozzle.

As shown in FIG. 5, the removable atomizing nozzle unit 10 of the head 5 is formed of a first flow duct 19 connectable to the channel 18 for the compressed-air supply. In addition, the nozzle unit 10 is provided with a second inlet duct 20 leading to the lacquer in the bomb 1 and drawing lacquer therefor the Venturi principle.

The end **19*a* of the nozzle for the compressed air duct 19 is closed to the orifice end 20*a* of the nozzle for the aspirated lacquer duct 20. The duct 20, 20*a* for drawing the lacquer ends in an upper cone 21, separated by a vertical notch 22 from the orifice 19*a* of the duct 19. The vertical notch 22 is most important for the safe operation of the nozzle unit 10, because it is this vertical notch 22** which allows the perfect and really surprising atomising effect.

The cone 21 containing the orifice **20*a* of the duct 20 prevents the formation of droplets at the end of of the atomizing phase and therewith prevents the blocking of the ducts 19, 19*a*, 20, 20*a***.

What we claim is:

1. A atomizer for cosmetic products in particular hair lacquers, said atomizer comprising:

(A) a pair of lacquer-containing bombs, (B) a portable compressed air-source, (C) a housing body having seats for reception of said bombs and for said compressed air-source, (D) hoses connecting said portable compressed air-source to said bombs, (E) each bomb comprising (I) a lacquer containing lower part and (II) a detachable head mounted on said lower part (a) said head including a depressible cover with a flat crown, (III) said head having an atomizing unit, said atomizing unit constituting (a) a compressed air-nozzle and (b) a lacquer supplying nozzle, (IV) passageway means connecting the air-hose for that bomb with the compressed air-nozzle, (V) a controllable biased check valve interposed in said passageway means, (VI) passageway means connecting the lacquer in said lower part with said lacquer supply nozzle (VII) said check valve being in operative relationship to said crown whereby depression of said crown opens said valve (VIII) said compressed air-nozzle terminating at an orifice (IX) said lacquer supplying nozzle terminating in a conic end near said orifice (X) said orifice being separated from said conic end by a notch (F) each said hose being wound around its associated bomb to provide a combination transverse dimension of the bomb and hose small enough to be received in the seat of the housing body.

2. An atomizer according to claim 1 wherein the notch between the lacquer supplying orifice and the conic end is situated in a plane perpendicular to the flow axis of the compressed air-nozzle.

3. A atomizer according to claim 1 wherein the valve body has a peripheral groove open on the outside and communicating, when the valve is mounted in the respective head part, with a channel for the compressed air flow provided in said head part and ending into the seat for housing the nozzle duct of the nozzle for the compressed air flow.

4. An atomizer according to claim 1 wherein the seat housing said compressed air source is a bay in the rear part of the housing body.

* * * * *